US009562326B2

(12) United States Patent
Lu et al.

(10) Patent No.: US 9,562,326 B2
(45) Date of Patent: Feb. 7, 2017

(54) COMPOSITIONS AND METHODS OF MAKING PAPER PRODUCTS

(71) Applicant: Kemira Oyj, Helsinki (FI)

(72) Inventors: Chen Lu, Marietta, GA (US); Scott Rosencrance, Douglasville, GA (US); Vladimir Grigoriev, Atlanta, GA (US)

(73) Assignee: KEMIRA OYJ, Helsinki (FI)

( * ) Notice: Subject to any disclaimer, the term of this patent is extended or adjusted under 35 U.S.C. 154(b) by 0 days.

(21) Appl. No.: 14/208,486

(22) Filed: Mar. 13, 2014

(65) Prior Publication Data

US 2014/0262091 A1 Sep. 18, 2014
US 2016/0281300 A9 Sep. 29, 2016

Related U.S. Application Data

(60) Provisional application No. 61/782,194, filed on Mar. 14, 2013.

(51) Int. Cl.

| | |
|---|---|
| ***D21H 17/55*** | (2006.01) |
| ***D21H 17/47*** | (2006.01) |
| ***D21H 21/18*** | (2006.01) |
| ***D21H 17/49*** | (2006.01) |
| ***D21H 17/54*** | (2006.01) |
| ***D21H 17/56*** | (2006.01) |
| ***D21H 21/20*** | (2006.01) |
| ***D21H 17/07*** | (2006.01) |

(52) U.S. Cl.
CPC ..... *D21H 17/55* (2013.01); *D21H 17/07* (2013.01); *D21H 17/47* (2013.01); *D21H 17/49* (2013.01); *D21H 17/54* (2013.01); *D21H 17/56* (2013.01); *D21H 21/18* (2013.01); *D21H 21/20* (2013.01)

(58) Field of Classification Search
CPC ..... D21H 17/55; D21H 21/20; D21H 21/18; D21H 17/375; D21H 17/56; D21H 17/07; D21H 17/47; D21H 17/53
USPC ..... 162/158, 164.1, 164.3, 164.6,162/168.1–168.3, 168.7, 165–167
See application file for complete search history.

(56) References Cited

U.S. PATENT DOCUMENTS

| | | | | |
|---|---|---|---|---|
| 2,601,598 | A * | 6/1952 | Wilson et al. | 162/167 |
| 2,658,828 | A * | 11/1953 | Pattilloch | 162/164.1 |
| 2,926,116 | A | 2/1960 | Keim | |
| 2,926,117 | A * | 2/1960 | Wittcoff | 162/164.6 |
| 2,926,154 | A | 2/1960 | Keim | |
| 3,019,156 | A * | 1/1962 | Lundberg et al. | 162/166 |
| 3,180,787 | A * | 4/1965 | Adams | 162/163 |
| 3,556,932 | A * | 1/1971 | Coscia et al. | 162/166 |
| 3,556,933 | A | 1/1971 | Williams | |
| 4,129,722 | A | 12/1978 | Iovine | |
| 4,198,269 | A * | 4/1980 | Evani et al. | 162/164.3 |
| 4,297,860 | A | 11/1981 | Pacifici et al. | |
| 4,514,345 | A | 4/1985 | Johnson et al. | |
| 4,528,239 | A | 7/1985 | Trokhan | |
| 4,605,702 | A | 8/1986 | Guerro et al. | |
| 4,773,110 | A | 9/1988 | Hopkins | |
| 5,017,642 | A | 5/1991 | Hasegawa et al. | |
| 5,019,606 | A | 5/1991 | Marten et al. | |
| 5,085,736 | A | 2/1992 | Bjorkquist | |
| 5,098,522 | A | 3/1992 | Smurkoski et al. | |
| 5,171,795 | A | 12/1992 | Miller et al. | |
| 5,260,171 | A | 11/1993 | Smurkoski et al. | |
| 5,275,700 | A | 1/1994 | Trokhan | |
| 5,278,255 | A * | 1/1994 | Weaver et al. | 525/421 |
| 5,328,565 | A | 7/1994 | Rasch et al. | |
| 5,334,289 | A | 8/1994 | Trokhan et al. | |
| 5,336,373 | A | 8/1994 | Scattolino et al. | |
| 5,373,087 | A * | 12/1994 | Weaver et al. | 528/335 |
| 5,397,436 | A * | 3/1995 | Robeson et al. | 162/158 |
| 5,431,786 | A | 7/1995 | Rasch et al. | |
| 5,488,139 | A * | 1/1996 | Dragner et al. | 560/155 |
| 5,496,624 | A | 3/1996 | Stelljes, Jr. et al. | |
| 5,500,277 | A | 3/1996 | Trokhan et al. | |
| 5,502,091 | A * | 3/1996 | Dasgupta | 524/55 |
| 5,514,523 | A | 5/1996 | Trokhan et al. | |
| 5,554,467 | A | 9/1996 | Trokhan et al. | |
| 5,566,724 | A | 10/1996 | Trokhan et al. | |
| 5,567,798 | A * | 10/1996 | Dulany et al. | 528/332 |
| 5,614,597 | A | 3/1997 | Bower | |
| 5,624,790 | A | 4/1997 | Trokhan et al. | |
| 5,628,876 | A | 5/1997 | Ayers et al. | |
| 5,760,212 | A * | 6/1998 | Smith | 536/123.1 |
| 5,783,041 | A * | 7/1998 | Underwood | 162/164.1 |
| 5,830,320 | A * | 11/1998 | Park et al. | 162/164.1 |
| 6,059,928 | A * | 5/2000 | Van Luu et al. | 162/111 |
| 6,153,053 | A * | 11/2000 | Harper et al. | 162/109 |

(Continued)

FOREIGN PATENT DOCUMENTS

| | | | |
|---|---|---|---|
| DE | 4241117 A1 * | 6/1994 | |
| WO | WO00/43428 | 7/2000 | |

(Continued)

OTHER PUBLICATIONS

Chinese Office Action issued by the Chinese Patent Office (SIPO) in relation to Chinese Application No. 201480024121.8 dated Aug. 5, 2016 (12 pages) along with the English translation (16 pages).

*Primary Examiner* — Jose Fortuna
(74) *Attorney, Agent, or Firm* — Robert P. Michael, Esq.; Carter, DeLuca, Farrell & Schmidt, LLP

(57) ABSTRACT

One or more embodiments include paper, methods of making paper, compositions, and the like, are provided. In various exemplary embodiments described herein, a paper material may be formed by treating a cellulosic fiber or an aqueous pulp slurry, with a strength including a polyamine resin.

15 Claims, No Drawings

(56) References Cited

U.S. PATENT DOCUMENTS 6,210,528 B1 4/2001 Wolkowicz
6,224,714 B1 5/2001 Schroeder et al.
6,306,249 B1 10/2001 Galante et al.
6,355,137 B1 * 3/2002 Staib ..... 162/5
6,576,086 B1 * 6/2003 Ettl et al. ..... 162/164.3
6,824,648 B2 * 11/2004 Edwards et al. ..... 162/111
7,081,512 B2 7/2006 Riehle
7,897,013 B2 * 3/2011 Hagiopol et al. ..... 162/166
8,288,502 B2 * 10/2012 Bode ..... C08L 33/26 162/164.1
8,753,480 B2 * 6/2014 Bode ..... C08L 33/26 162/158
8,840,759 B2 * 9/2014 Benz ..... D21H 17/16 162/158
8,894,817 B1 * 11/2014 Cheng et al. ..... 162/168.3
8,999,110 B2 * 4/2015 Hagiopol et al. ..... 162/164.6
9,145,646 B2 * 9/2015 Benz ..... D21H 17/16
2004/0144511 A1 * 7/2004 McKay et al. ..... 162/158
2004/0188047 A1 * 9/2004 Nakamura et al. ..... 162/164.6
2004/0206466 A1 * 10/2004 Kokko et al. ..... 162/158
2004/0231816 A1 * 11/2004 Steeg et al. ..... 162/199
2006/0037727 A1 * 2/2006 Hagiopol et al. ..... 162/168.3
2007/0056706 A1 * 3/2007 Crisp et al. ..... 162/164.3
2008/0093040 A1 * 4/2008 Antal et al. ..... 162/164.6
2008/0149287 A1 * 6/2008 Hagiopol et al. ..... 162/164.6
2008/0271867 A1 * 11/2008 Donner ..... 162/181.6
2008/0302497 A1 * 12/2008 Storsberg et al. ..... 162/164.6
2008/0308242 A1 12/2008 Lu et al.
2009/0071618 A1 * 3/2009 Zhang et al. ..... 162/164.6
2010/0108279 A1 * 5/2010 Schall et al. ..... 162/164.5
2011/0146925 A1 * 6/2011 Bode ..... C08L 33/26 162/164.1
2012/0043037 A1 * 2/2012 Polat et al. ..... 162/123
2012/0118523 A1 * 5/2012 Lu et al. ..... 162/164.6
2012/0199298 A1 * 8/2012 Dyer ..... 162/123
2012/0199299 A1 * 8/2012 Dyer ..... 162/123
2012/0247697 A1 * 10/2012 Lu et al. ..... 162/111
2013/0081771 A1 * 4/2013 Luo et al. ..... 162/164.6
2013/0160959 A1 * 6/2013 Rosencrance et al. .... 162/164.6
2014/0060763 A1 * 3/2014 Bode ..... C08L 33/26 162/164.6
2014/0158316 A1 * 6/2014 Luo et al. ..... 162/164.3
2014/0262091 A1 * 9/2014 Lu et al. ..... 162/164.6
2014/0284011 A1 * 9/2014 Krapsch et al. ..... 162/168.3
2014/0336314 A1 * 11/2014 Benz ..... D21H 17/16 524/112
2015/0144282 A1 * 5/2015 Lu et al. ..... 162/164.5
2015/0176206 A1 * 6/2015 Chen et al.
2015/0197893 A1 * 7/2015 Cheng et al.
2016/0281300 A9 * 9/2016 Lu ..... D21H 17/47

FOREIGN PATENT DOCUMENTS

WO WO0050462 8/2000
WO WO0134903 5/2001
WO WO0149937 7/2001
WO WO0183887 11/2001
WO WO-2013/026578 A1 2/2013
WO WO 2013095952 A1 * 6/2013
WO WO 2013192082 A1 * 12/2013

* cited by examiner

COMPOSITIONS AND METHODS OF MAKING PAPER PRODUCTS

CLAIM OF PRIORITY TO RELATED APPLICATION

This application claims priority to U.S. provisional application entitled "COMPOSITIONS AND METHODS OF MAKING PAPER PRODUCTS" having Ser. No. 61/782,194, filed on Mar. 14, 2013, which is entirely incorporated herein by reference.

BACKGROUND

1. Field of the Art

The present embodiments relate to paper and paper making.

2. Description of Related Art

Paper is sheet material containing interconnected small, discrete fibers. The fibers are usually formed into a sheet on a fine screen from a dilute water suspension or slurry. Paper typically is made from cellulose fibers, although occasionally synthetic fibers are used. Paper products made from untreated cellulose fibers lose their strength rapidly when they become wet, i.e., they have very little wet strength. Wet strength resin can be added to the paper to produce stronger paper products. The types of wet strength resins that can be applied to paper may be either of the "permanent" or "temporary" type, which are defined, in part, by how long the paper retains its wet strength after immersion in water.

A common permanent wet strength resin is an epichlorohydrin-based wet strength resin, such as polyamidoamine epichlorohydrin (PAE). Conventional PAE resins can be prepared by reacting polyamidoamine with epichlorohydrin in the mole ratio of epichlorohydrin to secondary amine groups being from about 0.5 to 1 to about 1.8 to 1 (for example, as discussed in U.S. Pat. Nos. 2,926,116, 2,926,154, 5,171,795, 5,614,597, 5,017,642, 5,019,606, and 7,081,512, each of which is incorporated herein by reference). High permanent wet strength often leads to re-pulping issues during papermaking production. In addition, sanitary paper products with high permanent wet strength may clog sewage systems and/or septic tanks.

Glyoxalated polyacrylamide (GPAM) is a common temporary wet strength resin. GPAM is typically prepared by reacting glyoxal and a cationic polyacrylamide base polymer (for example, as discussed in U.S. Pat. Nos. 3,556,932, 4,605,702, 7,828,934, and US. Pat. Application Publication No. 2008/0308242, which are herein incorporated by reference). GPAM is typically added in the pulp suspension before paper sheet formation. Upon drying of the treated paper sheet, GPAM is believed to form covalent bonds with paper cellulose to increase paper dry strength. Since the covalent bond between GPAM and cellulose is reversible in water, this wet strength may decrease over time. GPAM strength performance also can be adversely affected by relatively high pH and high levels of alkalinity when present as bicarbonate ions.

The description herein of certain advantages and disadvantages of known methods and compositions is not intended to limit the scope of the present disclosure. Indeed the present embodiments may include some or all of the features described above without suffering from the same disadvantages.

SUMMARY

In view of the foregoing, one or more embodiments include paper, methods of making paper, compositions, and the like.

At least one embodiment provides a paper formed by a method that includes treating a cellulosic fiber with a strength system comprising a polyamine resin.

At least one embodiment provides a paper formed by a method that includes treating a cellulosic fiber with a strength system consisting essentially of a polyamine resin.

At least one embodiment provides a paper formed by a method that includes treating a cellulosic fiber with a strength system consisting of a polyamine resin.

At least one embodiment provides a method of making a paper comprising: introducing to a cellulosic fiber a strength system comprising a polyamine resin.

At least one embodiment provides a method of making a paper comprising: introducing to a cellulosic fiber a strength system consisting essentially of a polyamine resin.

At least one embodiment provides a method of making a paper comprising: introducing to a cellulosic fiber a strength system consisting of a polyamine resin.

At least one embodiment provides a composition comprising a mixture of a polyamine resin and an aldehyde-functionalized polymer resin, wherein the weight ratio of aldehyde-functionalized polymer resin to polyamine resin is about 100:1 to about 1:100. In an embodiment, the polyamine resin comprises, consists essentially of, or consists of a polyamine.

For each of these embodiments and others present in the application, the polyamine is not polyamidoamine epichlorohydrin (PAE) or polyamine polyamidoamine epichlorohydrin (PPAE).

DETAILED DESCRIPTION OF THE EMBODIMENTS

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, synthetic organic chemistry, paper chemistry, and the like, which are within the skill of the art. Such techniques are explained fully in the literature.

The examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms and phrases that shall be defined to have the following meanings unless a contrary intention is apparent.

DEFINITIONS

The term "substituted" refers to any one or more hydrogens on the designated atom or in a compound that can be replaced with a selection from the indicated group, provided that the designated atom's normal valence is not exceeded, and that the substitution results in a stable compound.

"Acrylamide monomer" refers to a monomer of formula: $H_2C{=}C(R_1)C(O)NR_2R_3$, where $R_1$ is H or $C_1$-$C_4$ alkyl, $R_2$ and $R_3$ are H, $C_1$-$C_4$ alkyl, aryl or arylalkyl. Exemplary acrylamide monomers include acrylamide and methacrylamide.

"Aldehyde" refers to a compound containing one or more aldehyde (—CHO) groups, where the aldehyde groups are capable of reacting with the amino or amido groups of a polymer comprising amino or amido groups as described herein. Exemplary aldehydes can include formaldehyde, paraformaldehyde, glutaraldehyde, glyoxal, and the like.

"Aliphatic group" refers to a saturated or unsaturated, linear or branched hydrocarbon group and encompasses alkyl, alkenyl, and alkynyl groups, for example.

"Alkyl" refers to a monovalent group derived from a straight or branched chain saturated hydrocarbon by the removal of a single hydrogen atom. Exemplary alkyl groups include methyl, ethyl, n- and iso-propyl, cetyl, and the like.

"Alkylene" refers to a divalent group derived from a straight or branched chain saturated hydrocarbon by the removal of two hydrogen atoms. Exemplary alkylene groups include methylene, ethylene, propylene, and the like.

"Amido group" and "amide" refer to a group of formula $—C(O)NY_1Y_2$, where $Y_1$ and $Y_2$ are independently selected from H, alkyl, alkylene, aryl and arylalkyl.

"Amino group" and "amine" refer to a group of formula $—NY_3Y_4$, where $Y_3$ and $Y_4$ are independently selected from H, alkyl, alkylene, aryl, and arylalkyl.

"Aryl" refers to an aromatic monocyclic or multicyclic ring system of about 6 to about 10 carbon atoms. The aryl is optionally substituted with one or more $C_1$-$C_{20}$ alkyl, alkylene, alkoxy, or haloalkyl groups. Exemplary aryl groups include phenyl or naphthyl, or substituted phenyl or substituted naphthyl.

"Arylalkyl" refers to an aryl-alkylene-group, where aryl and alkylene are defined herein. Exemplary arylalkyl groups include benzyl, phenylethyl, phenylpropyl, 1-naphthylmethyl, and the like.

"Alkoxy" refers to an alkyl group as defined above with the indicated number of carbon atoms attached through an oxygen bridge. Exemplary alkoxy groups include methoxy, ethoxy, n-propoxy, i-propoxy, n-butoxy, s-butoxy, t-butoxy, n-pentoxy, and s-pentoxy.

"Halogen" refers to fluorine, chlorine, bromine, or iodine.

In an exemplary embodiment, the polyalkylene polyamine can include a polyethylene polyamine, a polypropylene polyamine, a polybutylene polyamine, a polypentylene polyamine, a polyhexylene polyamine, or a mixture thereof. In an exemplary embodiment, the polyalkylenepolyamines that may be used in the processes of the present disclosure may be represented as polyamines in which the nitrogen atoms are linked together by groups of formula $—C_nH_{2n}—$, where n is a small integer greater than unity and the number of such groups in the molecule ranges from two up to about eight. The nitrogen atoms may be attached to adjacent carbon atoms in the group $—C_nH_{2n}—$ or to carbon atoms further apart, but not to the same carbon atom.

Suitable polyamines of the present disclosure can include, but are not limited to, ethylene diamine (EDA), diethylenetriamine (DETA), triethylenetetramine (TETA), tetraethylenepentamine (TEPA), and dipropylenetriamine (DPTA), which can be obtained in reasonably pure form, but also as mixtures and various crude polyamine materials. For example, the mixture of polyethylene polyamines obtained by the reaction of ammonia and ethylene dichloride, refined only to the extent of removal of chlorides, water, excess ammonia, and ethylenediamine, is a satisfactory starting material. Additional polyamines of the present disclosure can include, but are not limited to, bis-hexamethylenetriamine (BHMT), N-methylbis(aminopropyl)amine (MBAPA), aminoethyl-piperazine (AEP), and other polyalkylenepolyamines (e.g., spermine, spermidine, and the like).

The term "polyalkylenepolyamine" as used herein can include any of the polyalkylenepolyamines referred to above or to a mixture of such polyalkylenepolyamines and derivatives thereof.

"Paper strength" means a property of a paper material, and can be expressed, inter alia, in terms of dry strength and/or wet strength. Dry strength is the tensile strength exhibited by the dry paper sheet, typically conditioned under uniform humidity and room temperature conditions prior to testing. Wet strength is the tensile strength exhibited by a paper sheet that has been wetted with water prior to testing.

As used herein, the terms "paper" or "paper product" (these two terms can be used interchangeably herein) is understood to include a sheet material that contains paper fibers, which may also contain other materials (e.g. organic particles, inorganic particles, and a combination thereof). Suitable paper fibers include natural and synthetic fibers, for example, cellulosic fibers, wood fibers of all varieties used in papermaking, other plant fibers, such as cotton fibers, fibers derived from recycled paper; and the synthetic fibers, such as rayon, nylon, fiberglass, or polyolefin fibers. The paper product may be composed only of synthetic fibers. Natural fibers may be mixed with synthetic fibers. For instance, in the preparation of the paper product, the paper web, or paper material may be reinforced with synthetic fibers, such as nylon or fiberglass, or impregnated with nonfibrous materials, such as plastics, polymers, resins, or lotions. As used herein, the terms "paper web" and "web" are understood to include both forming and formed paper sheet materials, papers, and paper materials containing paper fibers. The paper product may be a coated, laminated, or composite paper material. The paper product can be bleached or unbleached.

Paper can include, but is not limited to, writing papers and printing papers (e.g., uncoated mechanical, total coated paper, coated free sheet, coated mechanical, uncoated free sheet, and the like), industrial papers, tissue papers of all varieties, paperboards, cardboards, packaging papers (e.g., unbleached kraft paper, bleached kraft paper), wrapping papers, paper adhesive tapes, paper bags, paper cloths, toweling, wallpapers, carpet backings, paper filters, paper mats, decorative papers, disposable linens and garments, and the like.

Paper can include tissue paper products. Tissue paper products include sanitary tissues, household tissues, industrial tissues, facial tissues, cosmetic tissues, soft tissues, absorbent tissues, medicated tissues, toilet papers, paper towels, paper napkins, paper cloths, paper linens, and the like. Common paper products include printing grade (e.g., newsprint, catalog, rotogravure, publication, banknote, document, bible, bond, ledger, stationery), industrial grade (e.g., bag, linerboard, corrugating medium, construction paper, greaseproof, glassine), and tissue grade (sanitary, toweling, condenser, wrapping).

In an exemplary embodiment, tissue paper may be a felt pressed tissue paper, a pattern densified tissue paper, or a high bulk, uncompacted tissue paper. In an exemplary embodiment, the tissue paper may be creped or uncreped, of a homogeneous or multilayered construction, layered or non-layered (blended), and one-ply, two-ply, or three or more plies. In an exemplary embodiment, tissue paper includes soft and absorbent paper tissue products that are consumer tissue products.

"Paperboard" is a paper that is thicker, heavier, and less flexible than conventional paper. Many hardwood and softwood tree species are used to produce paper pulp by mechanical and chemical processes that separate the fibers from the wood matrix. Paperboard can include, but is not limited to, semi-chemical paperboard, linerboards, containerboards, corrugated medium, folding boxboard, and cartonboards.

In an exemplary embodiment, paper refers to a paper product such as dry paper board, fine paper, towel, tissue, and newsprint products. Dry paper board applications include liner, corrugated medium, bleached, and unbleached dry paper board.

In an embodiment, paper can include carton board, container board, and special board/paper. Paper can include boxboard, folding boxboard, unbleached kraft board, recycled board, food packaging board, white lined chipboard, solid bleached board, solid unbleached board, liquid paper board, linerboard, corrugated board, core board, wallpaper base, plaster board, book bindery board, wood pulp board, sack board, coated board, gypsum board and the like.

"Pulp" refers to a fibrous cellulosic material. Suitable fibers for the production of the pulps are all conventional grades, for example mechanical pulp, bleached and unbleached chemical pulp, recycled pulp, and paper stocks obtained from all annuals. Mechanical pulp includes, for example, groundwood, thermomechanical pulp (TMP), chemothermochemical pulp (CTMP), alkaline peroxide mechanical pulp (APMP), groundwood pulp produced by pressurized grinding, semi-chemical pulp, high-yield chemical pulp and refiner mechanical pulp (RMP). Examples of suitable chemical pulps are sulfate, sulfite, and soda pulps. The unbleached chemical pulps, which are also referred to as unbleached kraft pulp, can be particularly used.

"Pulp slurry" refers to a mixture of pulp and water. The pulp slurry is prepared in practice using water, which can be partially or completely recycled from the paper machine. It can be either treated or untreated white water or a mixture of such water qualities. The pulp slurry may contain interfering substances (e.g., fillers). The filler content of paper may be up to about 40% by weight. Suitable fillers are, for example, clay, kaolin, natural and precipitated chalk, titanium dioxide, talc, calcium sulfate, barium sulfate, alumina, satin white or mixtures of the stated fillers.

"Papermaking process" is a method of making paper products from pulp comprising, inter alia, forming an aqueous pulp slurry that can include a cellulosic fiber, draining the pulp slurry to form a sheet, and drying the sheet. The steps of forming the papermaking furnish, draining, and drying may be carried out in any conventional manner generally known to those skilled in the art.

In this disclosure, "consisting essentially of" or "consists essentially" or the like, when applied to methods and compositions encompassed by the present disclosure refers to compositions like those disclosed herein, but which may contain additional composition components or method steps. Such additional composition components or method steps, etc., however, do not materially affect the basic and novel characteristic(s) of the compositions or methods (e.g., higher dry strength and/or a higher permanent wet strength as compared to a paper that has not been treated with the composition), compared to those of the corresponding compositions or methods disclosed herein. "Consisting essentially of" or "consists essentially" or the like, when applied to methods and compositions encompassed by the present disclosure have the meaning ascribed in U.S. patent law and the term is open-ended, allowing for the presence of more than that which is recited so long as basic or novel characteristics of that which is recited is not changed by the presence of more than that which is recited, but excludes prior art embodiments.

General Discussion

In various exemplary embodiments described herein, a paper material may be formed by treating a cellulosic fiber or an aqueous pulp slurry with a strength system comprising a polyamine resin. In an exemplary embodiment, the treated cellulosic fiber or aqueous pulp slurry may show an improved paper strength (e.g., dry and/or wet strength) relative to cellulosic fiber or aqueous pulp slurry that is not treated.

In an exemplary embodiment, the polyamine resin includes a polyamine, for example a secondary polyamine.

In an exemplary embodiment, the polyamine can include an ammonium, an aliphatic amine, an aromatic amine, or a polyalkylene polyamine. In an exemplary embodiment, the polyamine can include: a secondary aliphatic amine or a secondary aromatic amine. In an exemplary embodiment, the polyamine is not polyamidoamine epichlorohydrin (PAE) or polyamine polyamidoamine epichlorohydrin (PPAE).

In an exemplary embodiment, the polyalkylene polyamine can include a polyethylene polyamine, a polypropylene polyamine, a polybutylene polyamine, a polypentylene polyamine, a polyhexylene polyamine, or a mixture thereof.

In an exemplary embodiment, the polyalkylenepolyamines may be represented as polyamines in which the nitrogen atoms are linked together by groups of formula —$C_nH_{2n}$— where n is a small (e.g., 1, 2, 3, 4, 5) integer greater than unity and the number of such groups in the molecule ranges from two up to about eight. The nitrogen atoms may be attached to adjacent carbon atoms in the group —$C_nH_{2n}$— or to carbon atoms further apart, but not to the same carbon atom.

In an exemplary embodiment, the polyamines can include, but are not limited to, ammonium, urea, aliphatic amines, aromatic amines, and combinations of two or more of these. In an exemplary embodiment, the polyamine is not polyamidoamine epichlorohydrin (PAE) or polyamine polyamidoamine epichlorohydrin (PPAE). In an exemplary embodiment, the polyamine is ammonium. In an exemplary embodiment, the polyamine is urea. In an exemplary embodiment, the polyamine is urea. In an exemplary embodiment, the polyamine is aliphatic amine. In an exemplary embodiment, the polyamine is aromatic amine.

In an exemplary embodiment, the polyamines can include, but are not limited to, ethylene diamine (EDA), diethylenetriamine (DETA), triethylenetetramine (TETA), tetraethylenepentamine (TEPA), dipropylenetriamine (DPTA), or any combination of two or more thereof, which can be obtained in reasonably pure form, but also mixtures and various crude polyamine materials. For example, the mixture of polyethylene polyamines obtained by the reaction of ammonia and ethylene dichloride, refined only to the extent of removal of chlorides, water, excess ammonia, and ethylenediamine, is a satisfactory starting material. In an exemplary embodiment, the polyamine is EDA. In an exemplary embodiment, the polyamine is DETA. In an exemplary embodiment, the polyamine is TETA. In an exemplary embodiment, the polyamine is TEPA. In an exemplary embodiment, the polyamine is DPTA.

In an exemplary embodiment, the polyamines can include, but are not limited to, bis-hexamethylenetriamine (BHMT), N-methylbis(aminopropyl)amine (MBAPA), aminoethyl-piperazine (AEP), pentaethylenehexamine (PEHA), polyethyleneimine, other polyalkylenepolyamines (e.g., spermine, spermidine), and combinations of two or more of these. In an exemplary embodiment, the polyamine is BHMT. In an exemplary embodiment, the polyamine is MBAPA. In an exemplary embodiment, the polyamine is AEP. In an exemplary embodiment, the polyamine is PEHA. In an exemplary embodiment, the polyamine is polyethyleneimine.

In an exemplary embodiment, the polyamines can include polyamidoamine which is a condensation product of one or more of the polycarboxylic acids and/or polycarboxylic acid derivatives with one or more of the polyalkylene polyamines. The polyamidoamines can generally be prepared by heating a polycarboxylic acid and/or a polycarboxylic acid derivative with one or more of the polyamines as noted above at a temperature of about 125 to 200° C. for about 1 to 10 hours while collecting the water of condensation produced in the reaction at about atmospheric pressure. The reaction is usually allowed to proceed until the theoretical amount of water distillate is collected from the reaction. Where a reduced pressure is employed, a lower temperature of about 75° C. to 180° C. may be utilized. At the end of this reaction, the resulting product is dissolved in water at a concentration of about 20 to 90% by weight total polymer solids, about 30 to 80% by weight total polymer solids, or about 40 to 70% by weight total polymer solids. In the preparation of the polyamidoamines, the molar ratio of the polyamine to the polycarboxylic acid and/or polycarboxylic acid derivative can be about 0.8 to 2.0.

In an exemplary embodiment, an ester of polycarboxylic acids can include dimethyl adipate, dimethyl malonate, diethyl malonate, dimethyl succinate, dimethyl glutarate and diethyl glutarate. In an exemplary embodiment, the acid anhydride can include succinic anhydride, maleic anhydride, N,N,N',N'-ethylenediaminetetraacetate dianhydride, phthalic anhydride, mellitic anhydride, pyromellitic anhydride, or a mixture thereof. In an exemplary embodiment, the acid halide can include adipoyl chloride, glutaryl chloride, sebacoyl chloride, or a mixture thereof.

In an exemplary embodiment, the aldehyde-functionalized polymer resin can be produced by reacting a polymer including one or more hydroxyl, amine, or amide groups with one or more aldehydes. In an exemplary embodiment, the polymeric aldehyde-functionalized polymer resin can comprise gloxylated polyacrylamides, aldehyde-rich cellulose, aldehyde-functional polysaccharides, or aldehyde functional cationic, anionic or non-ionic starches. Exemplary materials include those disclosed in U.S. Pat. No. 4,129,722, which is herein incorporated by reference. An example of a commercially available soluble cationic aldehyde functional starch is Cobond® 1000 marketed by National Starch. Additional exemplary aldehyde-functionalized polymers may include aldehyde polymers such as those disclosed in U.S. Pat. No. 5,085,736; U.S. Pat. No. 6,274,667; and U.S. Pat. No. 6,224,714; all of which are herein incorporated by reference, as well as the those of WO 00/43428 and the aldehyde functional cellulose described in WO 00/50462 A1 and WO 01/34903 A1. In an exemplary embodiment, the polymeric aldehyde-functional resins can have a molecular weight of about 10,000 Da or greater, about 100,000 Da or greater, or about 500,000 Da or greater. Alternatively, the polymeric aldehyde-functionalized resins can have a molecular weight below about 200,000 Da, such as below about 60,000 Da.

In an exemplary embodiment, further examples of aldehyde-functionalized polymers can include dialdehyde guar, aldehyde-functional additives further comprising carboxylic groups as disclosed in WO 01/83887, dialdehyde inulin, and the dialdehyde-modified anionic and amphoteric polyacrylamides of WO 00/11046, each of which are herein incorporated by reference. Another exemplary aldehyde-functionalized polymer is an aldehyde-containing surfactant such as those disclosed in U.S. Pat. No. 6,306,249, which is incorporated herein by reference.

When used in an exemplary embodiment, the aldehyde-functionalized polymer can have at least about 5 milliequivalents (meq) of aldehyde per 100 grams of polymer, more specifically at least about 10 meq, more specifically about 20 meq or greater, or most specifically about 25 meq, per 100 grams of polymer or greater.

In an exemplary embodiment, the polymeric aldehyde-functionalized polymer can be a glyoxylated polyacrylamide, such as a cationic glyoxylated polyacrylamide as described in U.S. Pat. No. 3,556,932, U.S. Pat. No. 3,556,933, U.S. Pat. No. 4,605,702, U.S. Pat. No. 7,828,934, and U.S. Patent Application 20080308242, each of which is incorporated herein by reference. Such compounds include FENNOBOND™ 3000 and PAREZ™ 745 from Kemira Chemicals of Helsinki, Finland, HERCOBOND™ 1366, manufactured by Hercules, Inc. of Wilmington, Del.

In an exemplary embodiment, the aldehyde functionalized polymer is a glyoxalated polyacrylamide resin having the ratio of the number of substituted glyoxal groups to the number of glyoxal-reactive amide groups being in excess of about 0.03:1, being in excess of about 0.10:1, or being in excess of about 0.15:1.

In an exemplary embodiment, the aldehyde functionalized polymer can be a glyoxalated polyacrylamide resin having a polyacrylamide backbone with a molar ratio of acrylamide to dimethyldiallylammonium chloride of about 99:1 to 50:50, about 98:1 to 60:40, or about 96:1 to 75:25. In an exemplary embodiment, the weight average molecular weight of the polyacrylamide backbone can be about 250,000 Da or less, about 150,000 Da or less, or about 100,000 Da or less. The Brookfield viscosity of the polyacrylamide backbone can be about 10 to 10,000 cps, about 25 to 5000 cps, about 50 to 2000 cps, for a 40% by weight aqueous solution.

In an exemplary embodiment, the weight ratio of the aldehyde-functionalized polymer resin to polyamine can be about 1:100 to 100:1, or about 1:50 to 50:1, or about 1:20 to 20:1. It should be noted in an exemplary embodiment the ratio can be modified to provide performance and/or cost characteristics, as necessary or desired.

Although not intending to be bound by theory, the polyamine can react with the aldehyde-functionalized polymer to form an enamine, which can lead to a complex formation between the polyamine and the aldehyde-functionalized polymer.

As mentioned above, exemplary embodiments of the present disclosure include paper formed by a method that includes treating a cellulosic fiber with a strength system comprising, consisting essentially of, or consisting of a polyamine resin. In an exemplary embodiment, the polyamine is not polyamidoamine epichlorohydrin (PAE) or polyamine polyamidoamine epichlorohydrin (PPAE).

As mentioned above, exemplary embodiments of the present disclosure include a method of making a paper, where the method includes: introducing to a cellulosic fiber a strength system comprising, consisting essentially of, or consisting of a polyamine resin. In an exemplary embodiment, the polyamine is not polyamidoamine epichlorohydrin (PAE) or polyamine polyamidoamine epichlorohydrin (PPAE).

As mentioned above, exemplary embodiments of the present disclosure include a composition that includes a mixture of a polyamine resin and an aldehyde-functionalized polymer resin, where the weight ratio of aldehyde-functionalized polymer resin to polyamine resin is about 50:1 to about 1:50. In an embodiment, the polyamine resin comprises, consists essentially of, or consists of a polyamine. In an exemplary embodiment, the polyamine is not polyamidoamine epichlorohydrin (PAE) or polyamine polyamidoamine epichlorohydrin (PPAE).

In an exemplary embodiment, one or more of the strength systems provided herein may be provided to a pulp slurry, which may be used to produce a paper product. As a result, the strength system is dispersed throughout the resultant paper product.

In an exemplary embodiment, the strength system (or one or more components thereof) can be applied as an aqueous solution(s) to the cellulosic fibers, fibrous slurry, or individual fibers. In addition to being applied as an aqueous solution, the strength system (or one or more components thereof) can also be applied in the form of a suspension, a slurry, or as a dry reagent depending upon the particular application. In one exemplary embodiment, strength system may be provided as a dry reagent, with sufficient water to permit interaction of the components of the strength system.

In an exemplary embodiment, the individual components of the strength system may be combined first and then applied to the cellulosic fibers. In an exemplary embodiment, the individual components may be applied sequentially in any order. In an exemplary embodiment, the groups of individual components can be combined and then applied to the cellulosic fibers simultaneously or sequentially.

By way of example only, application of the strength system (or one or more components thereof) can be applied by any of the following methods or combinations thereof.

In an exemplary embodiment, the method can include direct addition of the strength system (or one or more components thereof) to a fibrous slurry, such as by injection of the component into a slurry prior to entry in the headbox. In an exemplary embodiment, the slurry can be about 0.05% to about 50%, about 0.1% to 10%, about 0.15% to about 5%, or about 0.2% to about 4%.

In an exemplary embodiment, the method can include spraying the strength system (or one or more components thereof) on to a fibrous web. For example, spray nozzles may be mounted over a moving paper web to apply a desired dose of a solution to a web that can be moist or substantially dry.

In an exemplary embodiment, the method can include application of the strength system (or one or more components thereof) by spray or other means to a moving belt or fabric, which in turn contacts the tissue web to apply the chemical to the web, such as is disclosed in WO 01/49937.

In an exemplary embodiment, the method can include printing the strength system (or one or more components thereof) onto a web, such as by offset printing, gravure printing, flexographic printing, ink jet printing, digital printing of any kind, and the like.

In an exemplary embodiment, the method can include coating the strength system (or one or more components thereof) onto one or both surfaces of a web, such as blade coating, air knife coating, short dwell coating, cast coating, and the like.

In an exemplary embodiment, the method can include extrusion from a die head of the strength system (or one or more components thereof) in the form of a solution, a dispersion or emulsion, or a viscous mixture.

In an exemplary embodiment, the method can include application of the strength system (or one or more components thereof) to individualized fibers. For example, comminuted or flash dried fibers may be entrained in an air stream combined with an aerosol or spray of the compound (s) to treat individual fibers prior to incorporation into a web or other fibrous product.

In an exemplary embodiment, the method can include impregnation of a wet or dry web with a solution or slurry of strength system (or one or more components thereof), where the strength system (or one or more components thereof) penetrates a significant distance into the thickness of the web, such as about 20% or more of the thickness of the web, about 30% or more of the thickness of the web, and about 70% or more of the thickness of the web, including completely penetrating the web throughout the full extent of its thickness.

In an embodiment, the method for impregnation of a moist web can include the use of the Hydra-Sizer® system, produced by Black Clawson Corp., Watertown, N.Y., as described in "New Technology to Apply Starch and Other Additives," Pulp and Paper Canada, 100(2): T42-T44 (February 1999). This system includes a die, an adjustable support structure, a catch pan, and an additive supply system. A thin curtain of descending liquid or slurry is created which contacts the moving web beneath it. Wide ranges of applied doses of the coating material are said to be achievable with good runnability. The system can also be applied to curtain coat a relatively dry web, such as a web just before or after creping.

In an exemplary embodiment, the method can include a foam application of the strength system (or one or more components thereof) to a fibrous web (e.g., foam finishing), either for topical application or for impregnation of the additive into the web under the influence of a pressure differential (e.g., vacuum-assisted impregnation of the foam). Principles of foam application of additives such as binder agents are described in the following publications: F. Clifford, "Foam Finishing Technology: The Controlled Application of Chemicals to a Moving Substrate," *Textile Chemist and Colorist*, Vol. 10, No. 12, 1978, pages 37-40; C. W. Aurich, "Uniqueness in Foam Application," Proc. 1992 *Tappi Nonwovens Conference*, Tappi Press, Atlanta, Ga., 1992, pp. 15-19; W. Hartmann, "Application Techniques for Foam Dyeing & Finishing", Canadian Textile Journal, April 1980, p. 55; U.S. Pat. No. 4,297,860, and U.S. Pat. No. 4,773,110, each of which is herein incorporated by reference.

In an exemplary embodiment, the method can include padding of a solution containing the strength system (or one or more components thereof) into an existing fibrous web.

In an exemplary embodiment, the method can include roller fluid feeding of a solution of strength system (or one or more components thereof) for application to the web.

When applied to the surface of a paper web, an exemplary embodiment of the present disclosure may include the topical application of the strength system (or one or more components thereof) on an embryonic web prior to Yankee drying or through drying.

In an exemplary embodiment, the application level of the strength system can be about 0.05% to about 10% by weight relative to the dry mass of the web for any of the strength systems. In an exemplary embodiment, the application level can be about 0.05% to about 4%, or about 0.1% to about 2%. Higher and lower application levels are also within the scope of the embodiments. In some embodiments, for example, application levels of from about 5% to about 50% or higher can be considered.

In an exemplary embodiment, the strength system when combined with the web or with cellulosic fibers can have any pH, though in many embodiments it is desired that the strength system is in solution in contact with the web or with fibers have a pH below about 10, about 9, about 8 or about 7, such as about 2 to about 8, about 2 to about 7, about 3 to about 6, and about 3 to about 5.5. Alternatively, the pH range may be about 5 to about 9, about 5.5 to about 8.5, or about 6 to about 8. These pH values can apply to the polyamine resin prior to contacting the web or fibers, or to a mixture of the strength system in contact with the web or the fibers prior to drying.

In an exemplary embodiment, before the strength system is applied to an existing web, such as a moist embryonic web, the solids level of the web may be about 10% or higher (i.e., the web comprises about 10 grams of dry solids and 90 grams of water, such as about any of the following solids levels or higher: about 12%, about 15%, about 18%, about 20%, about 25%, about 30%, about 35%, about 40%, about 45%, about 50%, about 60%, about 75%, about 80%, about 90%, about 95%, about 98%, and about 99%, with exemplary ranges of about 30% to about 100% or about 65% to about 90%).

Ignoring the presence of chemical compounds other than the strength system and focusing on the distribution of the strength system in the web, one skilled in the art will recognize that the strength system (including one or more components and/or derivatives thereof) can be distributed in a wide variety of ways. For example, the strength system may be uniformly distributed, or present in a pattern in the web, or selectively present on one surface or in one layer of a multilayered web. In multi-layered webs, the entire thickness of the paper web may be subjected to application of the strength system and other chemical treatments described herein, or each individual layer may be independently treated or untreated with the strength system and other chemical treatments of the present disclosure. In an exemplary embodiment, the strength system is predominantly applied to one layer in a multilayer web. Alternatively, at least one layer is treated with significantly less strength system than other layers. For example, an inner layer can serve as a treated layer.

In an exemplary embodiment, the strength system may also be selectively associated with one of a plurality of fiber types, and may be adsorbed or chemisorbed onto the surface of one or more fiber types. For example, bleached kraft fibers can have a higher affinity for the strength system than synthetic fibers that may be present.

In an exemplary embodiment, certain chemical distributions may occur in webs that are pattern densified, such as the webs disclosed in any of the following U.S. Pat. No. 4,514,345; U.S. Pat. No. 4,528,239; U.S. Pat. No. 5,098,522; U.S. Pat. No. 5,260,171; U.S. Pat. No. 5,275,700; U.S. Pat. No. 5,328,565; U.S. Pat. No. 5,334,289; U.S. Pat. No. 5,431,786; U.S. Pat. No. 5,496,624; U.S. Pat. No. 5,500,277; U.S. Pat. No. 5,514,523; U.S. Pat. No. 5,554,467; U.S. Pat. No. 5,566,724; U.S. Pat. No. 5,624,790; and U.S. Pat. No. 5,628,876, the disclosures of which are incorporated herein by reference to the extent that they are non-contradictory herewith.

In an exemplary embodiment, the strength system or other chemicals can be selectively concentrated in the densified regions of the web (e.g., a densified network corresponding to regions of the web compressed by an imprinting fabric pressing the web against a Yankee dryer, where the densified network can provide good tensile strength to the three-dimensional web). This is particularly so when the densified regions have been imprinted against a hot dryer surface while the web is still wet enough to permit migration of liquid between the fibers to occur by means of capillary forces when a portion of the web is dried. In this case, migration of the aqueous solution of strength system can move the strength system toward the densified regions experiencing the most rapid drying or highest levels of heat transfer.

The principle of chemical migration at a microscopic level during drying is well attested in the literature. See, for example, A. C. Dreshfield, "The Drying of Paper," *Tappi Journal*, Vol. 39, No. 7, 1956, pages 449-455; A. A. Robertson, "The Physical Properties of Wet Webs. Part I," *Tappi Journal*, Vol. 42, No. 12, 1959, pages 969-978; U.S. Pat. No. 5,336,373, and U.S. Pat. No. 6,210,528, each of which is herein incorporated by reference.

Without wishing to be bound by theory, it is believed that chemical migration may occur during drying when the initial solids content (dryness level) of the web is below about 60% (e.g., less than any of about 65%, about 63%, about 60%, about 55%, about 50%, about 45%, about 40%, about 35%, about 30%, and about 27%, such as about 30% to 60%, or about 40% to about 60%). The degree of chemical migration can depend, for example, on the surface chemistry of the fibers, the chemicals involved, the details of drying, the structure of the web, and so forth. On the other hand, if the web with a solid contents below about 60% is through-dried to a high dryness level, such as at least any of about 60% solids, about 70% solids, and about 80% solids (e.g., from 65% solids to 99% solids, or from 70% solids to 87% solids), then regions of the web disposed above the deflection conduits (i.e., the bulky "domes" of the pattern-densified web) may have a higher concentration of strength system or other water-soluble chemicals than the densified regions, for drying will tend to occur first in the regions of the web through which air can readily pass, and capillary wicking can bring fluid from adjacent portions of the web to the regions where drying is occurring most rapidly. In short, depending on how drying is carried out, water-soluble reagents may be present at a relatively higher concentration (compared to other portions of the web) in the densified regions or the less densified regions ("domes").

In an exemplary embodiment, the strength system (or one or more components or derivatives thereof) may also be present substantially uniformly in the web, or at least without a selective concentration in either the densified or undensified regions.

According to an exemplary method, the conditions (e.g., temperature of the pulp slurry, temperature of pre-mixing the components, time of pre-mixing the components, concentration of the paper solution, co-mixing of solids, and the like) of the pulp slurry and process can vary, as necessary or desired, depending on the particular paper product to be formed, characteristics of the paper product formed, and the like. In an embodiment, the temperature of the pulp slurry can be about 10 to 80° C. when the strength system is added to the pulp slurry. In an embodiment, the process variables may be modified as necessary or desired, including, for example, the temperature of pre-mixing the components, the time of pre-mixing the components, and the concentration of the pulp slurry.

In various exemplary embodiments a paper may be formed by the treatment of a cellulosic fiber or an aqueous pulp slurry with a strength system as described herein. The paper can be formed using one or more methods, including those described herein.

EXAMPLES

Now having described the embodiments, in general, the examples describe some additional embodiments. While embodiments are described in connection with the examples and the corresponding text and figures, there is no intent to limit embodiments of the disclosure to these descriptions. On the contrary, the intent is to cover all alternatives, modifications, and equivalents included within the spirit and scope of exemplary embodiments.

Tetraethylenepentamine (TEPA) is a commercial product from Huntsman Chemicals. Commercial glyoxalated polyacrylamide (GPAM) product Fennobond 3000 was obtained from Kemira Chemicals.

Polyamidoamine (Example 1)

Polyamidoamine was prepared by a condensation reaction of an excess amount of diethylenetriamine with adipic acid. The molar ratio of diethylenetriamine to adipic acid was 1.6. In particular, diethylenetriamine was added to a three neck flask. Adipic acid was then slowly added to the flask and the reaction mixture heated to 165-170° C. and maintained for a period of 5 hours. At the end of the reaction, the product was diluted with water to adjust the concentration to 60% and the temperature was lowered to room temperature.

Test Methods:

Dry Tensile Strength Test

Tensile strength is measured by applying a constant-rate-of-elongation to a sample and recording the force per unit width required to break a specimen. This procedure references TAPPI Test Method T494 (2001), which is incorporated herein by reference, and modified as described.

Initial Wet Tensile Strength Test

This test method is used to determine the initial wet tensile strength of paper or paperboard that has been in contact with water for 2 seconds. A 1-inch wide paper strip sample is placed in the tensile testing machine and wetted on both strip sides with distilled water by a paint brush. After the contact time of 2 seconds, the strip is elongated as set forth in 6.8-6.10 of TAPPI Test Method 494 (2001). The initial wet tensile is useful in the evaluation of the performance characteristics of tissue products, paper towels and other papers subjected to stress during processing or use while instantly wet. This method references U.S. Pat. No. 4,233,411, which are incorporated herein by reference, and modified as described. A low wet tensile strength indicates that the paper product can be repulped in water without significant mechanical energy or dispersed in water easily without clogging sewage systems.

Handsheet Preparation

In the following examples, handsheets were prepared using a pulp mixture of bleached hardwood and bleached softwood. Deionized water was used for furnish preparation, and an additional 150 ppm of sodium sulfate and 35 ppm of calcium chloride were added. The pH values of both the pulp suspension and dilution water were adjusted to 8.0 using dilute NaOH and sulfuric solutions. While mixing with an overhead agitator, a batch of 0.6% solids containing 8.7 g of cellulose fibers was treated with various strength agent samples (described below) that were diluted to 1% weight % with deionized water. After the addition of the strength agent, the pulp slurry was mixed for 30 seconds. Then, four 3-g sheets of paper were formed using a standard (8"×8") Nobel & Woods handsheet mold, to target a basis weight of 52 lbs/3000 $ft^2$. The handsheets were pressed between felts in the nip of a pneumatic roll press at about 15 psig and dried on a rotary dryer at 110° C. The paper samples were oven cured for 10 minutes at the temperature of 110° C., then conditioned in the standard TAPPI control room for overnight.

Handsheet Testing Result:

Table 1 provides the strength properties of handsheets treated with different strength resin systems. When GPAM was used in combination with a polyamine, two products were pre-mixed for one minute. Then, the pre-mixed samples were diluted to 1% before added to the pulp suspension. In summary, the combinations of GPAM and a polyamine delivered higher dry tensile strength and lower wet tensile strength. A higher dry tensile strength can indicate that the GPAM/polyamine combination can be applied to effectively increase paper dry strength, decrease pulp refining energy, and reduce total fiber usage. In addition, the lower wet tensile strength suggests that the paper product can be repulped in water without significant mechanical energy or dispersed in water easily without clogging sewage systems.

TABLE 1

Handsheet strength properties

| Experiment | Chemical 1 | Chemical 2 | Dry tensile strength (lb/in) | Initial wet tensile strength (lb/in) |
|---|---|---|---|---|
| 1 | NA | NA | 25.5 | 1.1 |
| 2 | 8 lb/t Fennobond 3000 | NA | 27 | 5.0 |
| 3 | 7 lb/t Fennobond 3000 | 1 lb/t TEPA | 28.8 | 4.2 |
| 4 | 6 lb/t Fennobond 3000 | 2 lb/t TEPA | 26.3 | 2.6 |
| 5 | 7 lb/t Fennobond 3000 | 1 lb/t Example 1 | 30.3 | 4.6 |
| 6 | 6 lb/t Fennobnd 3000 | 2 lb/t Example 1 | 27 | 4.5 |

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to the numerical value provided and the technique/system/apparatus used. In addition, the phrase "about 'x' to 'y'" includes "about 'x' to about 'y'".

It should be emphasized that the above-described embodiments of the present disclosure are merely possible examples of implementations, and are merely set forth for a clear understanding of the principles of this disclosure. Many variations and modifications may be made to the above-described embodiment(s) of the disclosure without departing substantially from the spirit and principles of the disclosure. All such modifications and variations are intended to be included herein within the scope of this disclosure and protected by the following claims.

We claim at least the following:

1. A paper formed by a method comprising treating a cellulosic fiber with a strength system comprising a polyamine resin in combination with an aldehyde-functionalized polymer resin, wherein the weight ratio of the aldehyde-functionalized polymer resin to polyamine is about 8:1 to 2.5:1, wherein the polyamine resin includes a polyamine or a polyamidoamine, wherein the polyamine or the polyamidomine is not a polyamidoamineepichlorohydrin or polyamine polyamidoamine epichlorohydrin, wherein the paper has a higher dry strength as compared to a paper that has not been treated with the strength system.

2. The paper of claim 1, wherein the polyamine resin includes a compound selected from the group consisting of: aliphatic amines, aromatic amines, polyalkylene polyamine, ethylene diamine (EDA), diethylenetriamine (DETA), triethylenetetramine (TETA), tetraethylenepentamine (TEPA), dipropylenetriamine (DPTA), bis-hexamethylenetriamine (BHMT), N-methylbis(aminopropyl)amine (MBAPA), aminoethyl-piperazine (AEP), pentaethylenehexamine (PEHA), polyethyleneimine, polyamidoamine, and a mixture thereof.

3. The paper of claim 1, wherein the polyamine resin is about 0.01 to 2.5 wt. % of an aqueous pulp slurry that includes the cellulosic fiber.

4. The paper of claim 1, wherein the paper is a paper product that is selected from the group consisting of: a dry paper board, a fine paper, a towel, a tissue, and a newsprint product.

5. The paper of claim 1, wherein the paper has a lower wet tensile strength as compared to a paper that has been treated only with the aldehyde-functionalized polymer resin component of the strength system.

6. The paper formed by the method of claim 1, wherein the weight ratio of the aldehyde-functionalized polymer resin to polyamine is about 7:1 to 3:1.

7. A method of making a paper, comprising: introducing to a cellulosic fiber a strength system comprising a polyamine resin in combination with an aldehyde-functionalized polymer resin, wherein the polyamine resin includes a polyamine or a polyamidoamine, wherein the polyamine or the polyamidomine is not a polyamidoamine epichlorohydrin or polyamine polyamidoamine epichlorohydrin, wherein the paper has a higher dry strength as compared to a paper that has not been treated with the strength system, wherein the weight ratio of the aldehyde-functionalized polymer resin to polyamine is about 8:1 to 2.5:1.

8. The method of claim 7, wherein the polyamine resin includes a polyamine selected from the group consisting of: aliphatic amines, aromatic amines, ethylene diamine (EDA), diethylenetriamine (DETA), triethylenetetramine (TETA), tetraethylenepentamine (TEPA), dipropylenetriamine (DPTA), bis-hexamethylenetriamine (BHMT), N-methylbis (aminopropyl)amine (MBAPA), aminoethyl-piperazine (AEP), pentaethylenehexamine (PEHA), polyethyleneimine, and a mixture thereof.

9. The method of claim 7, wherein the paper is a paper product that is selected from the group consisting of a dry paper board, a fine paper, a towel, a tissue, and a newsprint product.

10. The method of claim 7, wherein the aldehyde-functionalized polymer resin and the polyamine resin are mixed together prior to being mixed with the pulp slurry.

11. The method of claim 7, wherein the aldehyde-functionalized polymer resin and the polyamine resin are added to the cellulosic fiber simultaneously.

12. The method of claim 7, wherein the aldehyde-functionalized polymer resin and the polyamine resin are added to the cellulosic fiber sequentially.

13. The method of claim 7, wherein the aldehyde-functionalized polymer resin is added either directly to a pulp slurry or is sprayed on a paper web before drying the paper web.

14. The method of claim 7, wherein the polyamine resin is added either directly to a pulp slurry or is sprayed on a paper web before drying the paper web.

15. The method of claim 7, wherein the strength system consists of the polyamine resin and the aldehyde-functionalized polymer resin.

* * * * *